US010086491B2

(12) United States Patent
Baumgartner et al.

(10) Patent No.: US 10,086,491 B2
(45) Date of Patent: Oct. 2, 2018

(54) HONING TOOL AND METHOD FOR WORKING SEVERAL COAXIAL BORES

(71) Applicant: Gehring Technologies GmbH, Ostfildern (DE)

(72) Inventors: Erwin Baumgartner, Ostfildern (DE); Michael Rach, Altbach (DE)

(73) Assignee: GEHRING TECHNOLOGIES GMBH, Ostfildern (DE)

( * ) Notice: Subject to any disclaimer, the term of this patent is extended or adjusted under 35 U.S.C. 154(b) by 93 days.

(21) Appl. No.: 15/036,691

(22) PCT Filed: Nov. 12, 2014

(86) PCT No.: PCT/EP2014/074347
§ 371 (c)(1),
(2) Date: May 13, 2016

(87) PCT Pub. No.: WO2015/071294
PCT Pub. Date: May 21, 2015

(65) Prior Publication Data

US 2016/0354893 A1 Dec. 8, 2016

(30) Foreign Application Priority Data

Nov. 15, 2013 (DE) ..... 10 2013 223 293

(51) Int. Cl.
*B24B 33/08* (2006.01)
*B24B 5/40* (2006.01)
*B24B 5/06* (2006.01)

(52) U.S. Cl.
CPC ..... *B24B 33/08* (2013.01); *B24B 5/06* (2013.01); *B24B 5/40* (2013.01); *B24B 33/083* (2013.01)

(58) Field of Classification Search
CPC .... B24B 5/06; B24B 5/16; B24B 5/40; B24B 33/02; B24B 33/022; B24B 33/105;
(Continued)

(56) References Cited

U.S. PATENT DOCUMENTS 1,476,927 A * 12/1923 Schumann ..... B24B 33/08 451/476
1,689,589 A * 10/1928 Hutto ..... B24B 33/08 451/474
(Continued)

FOREIGN PATENT DOCUMENTS

CN 201102186 Y 8/2008
CN 202021538 U 11/2011
(Continued)

OTHER PUBLICATIONS

English Language Abstract of EP 0549821B1.
(Continued)

*Primary Examiner* — Timothy V Eley
(74) *Attorney, Agent, or Firm* — Ware, Fressola, Maguire & Barber LLP

(57) ABSTRACT

A honing tool for working several separate bores that are arranged coaxially in series and have different diameters. The honing tool includes several cutting bar groups arranged coaxially in series, wherein a diameter of a cutting bar group of the several cutting bar groups, which diameter is formed by radially extendable cutting bars, differs from a corresponding diameter of at least one other cutting bar group of the several cutting bar groups. A centering bar group is arranged in an axial direction to a free end of the honing tool adjacent at least one cutting bar group; or a guide bar group is arranged directly adjacent opposite the free end of the
(Continued)

honing tool adjacent the at least one cutting bar group, or both the centering bar group and the guide bar group are arranged accordingly.

21 Claims, 7 Drawing Sheets

(58) Field of Classification Search
CPC ..... B24B 33/08; B24B 33/082; B24B 33/083; B24B 33/084; B24B 33/087; B24B 39/02
See application file for complete search history.

(56) References Cited

U.S. PATENT DOCUMENTS 1,772,045 A * 8/1930 Hutto ..... B24B 33/08 451/474
1,796,060 A * 3/1931 Summers ..... B24B 33/08 451/476
2,082,737 A * 6/1937 Indge ..... B24B 33/08 451/474
2,195,061 A * 3/1940 Wallace ..... B24B 33/08 451/478
2,229,318 A * 1/1941 Wallace ..... B24B 33/083 451/151
2,242,028 A * 5/1941 Fussenhauser ..... B24B 33/08 451/476
3,369,330 A * 2/1968 Estabrook ..... B24B 33/083 451/476
3,458,961 A * 8/1969 Henry-Biabaud .... B24B 33/085 451/470
3,710,518 A * 1/1973 Grosseau ..... B24B 33/083 451/470
4,434,588 A * 3/1984 Wada ..... B24B 33/083 451/462
5,233,791 A * 8/1993 McQueen, Jr. ..... B21B 45/04 451/481
2010/0251623 A1* 10/2010 Uchiumi ..... B24B 33/08 51/293
2013/0058730 A1* 3/2013 Flores ..... B23B 29/03446 408/22
2015/0033530 A1* 2/2015 Langille ..... B24B 19/02 29/402.18
2017/0129070 A1* 5/2017 Flores ..... B24B 33/04

FOREIGN PATENT DOCUMENTS

DE 2903162 A1 7/1980
DE 3341507 5/1985
DE 4439381 5/1996
DE 19634415 2/1998
EP 0586791 A1 3/1994
EP 0549821 B1 7/1995
JP S5766855 A 4/1982

OTHER PUBLICATIONS

English Language Translation of CN201102186Y.
English Language Abstract of CN2202021538U.
English Language Abstract of JPS5766855.
DE4439381 English Language Abstract (1 page).
DE19634415 English Language Abstract (1 page).
DE3341507 English Language Abstract (2 pages).
English Language Abstract of DE2903162.

* cited by examiner

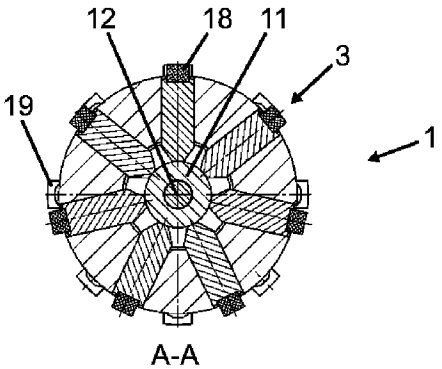
Fig. 4A
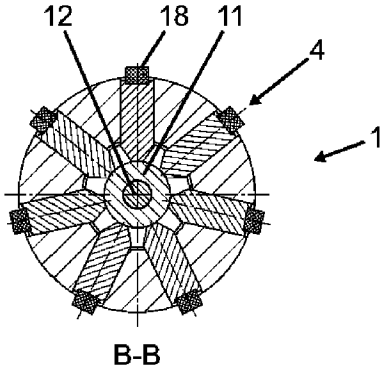
Fig. 4B
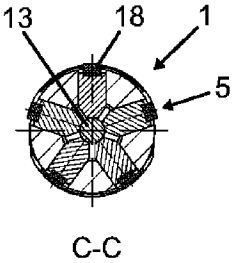
Fig. 4C
Fig. 4

HONING TOOL AND METHOD FOR WORKING SEVERAL COAXIAL BORES

BACKGROUND OF THE INVENTION

1. Field of Invention

The present invention relates to a honing tool for working several bars arranged coaxially in series and with different diameters, wherein the honing tool includes several cutting bar groups arranged coaxially in series, wherein a diameter of a cutting bar group, which diameter is formed by radially extendable cutting bars, differs from the diameter of at least one other cutting bar group. Furthermore, the invention relates to a method for working several bores arranged coaxially in series by a honing tool and a control device of a honing machine.

2. Brief Description of Related Art

Honing is a machining, fine working method that can be used in a versatile manner and with the aid of which among other things the accuracy of the dimension and of the position of cylindrical bores is improved.

Internal combustion engines of motor vehicles have bearing channels for the crankshaft, camshafts and/or compensation shafts. Bearing seats or bearing webs for the sliding bearings or roller bearings are arranged in these bearing channels. These bearing seats must be arranged coaxially to each other, i.e., they have a common central axis.

In the context of the invention the bearing seats are also designated as bores or as bore sections. A cylindrical bore with a constant diameter is designated as a through bore; examples for this are the bores 17*a* and 17*b* in FIG. 5.

A cylindrical bore with a shoulder and the resulting jump in diameter is designated as a stepped bore; an example for this are the bores 17*c* and the associated shoulder 17*d* in FIG. 5.

The axial distance of the individual bearing seats is frequently greater than its diameter. Therefore, the bore sections can only be worked by a relatively thin and long tool. These geometric border conditions make it difficult to achieve a good accuracy of the measurement and position of the bearing seats.

For example, DE 196 34 415 A1 shows a tool for working main bearing bores in crank housings with an upper and a lower guide range which can be adjusted to different diameters. A cutting range lies between the guide ranges in which deliverable bars with cutting coating are arranged. A lower guide range is adjusted to the measure of the pre-working of the bore and an upper guide range is adjusted so that it rests on the previously working bore. This tool is designed for the working of through bores with a unified diameter. No stepped bores can be worked with it.

DE 44 39 381 shows a tool for working individual bearing webs with a bearing seat of the crankshaft support of an internal combustion engine. A first, upper bearing web has a greater diameter than the bearing webs arranged underneath it. In order to work the bores the tool is constructed in a stepped shape, wherein the corresponding cutting bar groups are arranged axially in series and are adapted to the diameter of the bores. As a result, a coaxial working of lower, smaller bores and of the upper, larger bore is possible. All bores of the individual bearing webs must be constructed as a through bore.

SUMMARY OF THE INVENTION

The present invention provides a solution to the problem by creating a honing tool that can be used in a more versatile manner in comparison to the known honing tools.

In order to solve the problem, it is suggested that the cutting bar groups are constructed and arranged in such a manner that a through bore can be worked during a single work step by at least a first cutting bar group and that a stepped bore can be worked in a clamp and without a tool change by at least one second cutting bar group. Here, the cutting bar groups must be arranged on the honing tool in such a manner that they are coordinated with the position of the individual bores. The cutting bar groups comprise at least one cutting bar.

Alternatively, it is provided according to the invention that a first tool is provided for working the bearing webs with a through bore in order to supplement a second tool that is designed to work one or more stepped bores inside a series of concentric bores. This second tool is centered in at least one but preferably in several through bores of the bearing channel so that the stepped bore has a very good coaxiality with the passage bores at least after the honing work.

It is then possible in a method in accordance with the invention that the through bore and the stepped bore can be worked in a single work step. In the present application a work step denotes the introduction of the honing tool into the bore or the bearing channel, the working of all provided bores and the withdrawal of the honing tool.

Alternatively, it is also possible to work the through bores in a first work step with a first honing tool and subsequently or previously to work at least one stepped bore with another honing tool.

The method of the invention can be carried out on a standard honing machine which is designed, for example with a conventional double feed system and can automatically adjust the cutting speeds and radial feed positions for different honing methods (e.g. friction honing as well as conventional honing). The method can be implemented on the control device of the honing machine or in a control device designed especially for this task.

The honing tool of the invention and the method of the invention allow the working of through bores and of stepped bores with different diameters and arranged coaxially to each other in one or, if desired, in two work steps so that a tool change or a transport of the tool to another working station can be eliminated. The working time can be minimized as a result. Also, the expenses for the boring working are low since only a standard honing machine and the honing tool(s) is/are needed.

It is possible, as a result of the fact that the provided cutting bar groups are arranged in a honing tool on one axis (coaxial) for all bores, to achieve a high degree of coaxiality of all bores even in a series manufacture with a reliable process.

It is provided in a preferred embodiment that the cross sections of the cutting bar groups arranged coaxially in series are constructed to be either equally large or smaller as the distance from a tool receiving device increases. This makes possible an introduction of the honing tool into the bores.

It is provided in the method of the invention that at least one bore is worked by friction honing. This means that the honing procedure is carried out under rotation with very few strokes, e.g., a double stroke. Almost the entire removal of the material takes place here during the downwards stroke; the upward stroke serves rather to smooth the previously worked surface.

It is also provided during the same work step that at least one bore, preferably the stepped bore, is worked by oscillating honing. Oscillating honing denotes the conventional honing, that is, the rotation of the honing tool with simultaneous oscillating stroke movements. The cutting bar groups provided for the friction honing must not be in engagement with the associated bores in order that they or the bores are not adversely affected or damaged.

Furthermore, it is provided that a centering bar group is directly arranged on at least one cutting bar group in the axial direction toward the free end of the honing tool. The centering bar group comprises preferably at least three centering bars which stabilize the honing tool in its position in the individual working phases and guide it in the workpiece. The centering bar groups also serve, in particular at the beginning of the working, to align the honing tool in the bores. The centering bars can preferably not be radially adjusted. However, they could also be designed to be adjustable. The guide bars serve to center, stabilize and/or to avoid oscillations of the honing tool before and/or during the working by one or more cutting bar groups if, e.g. a cutting bar group is working a bore.

In the axial direction the centering bars are arranged as a rule in the direct vicinity of a group of cutting bars. This brings it about that during the working the cutting bars of the cutting bar group as well as the centering bars of the centering bar group are briefly located in the bore and therefore the centered position of the honing tool is always ensured.

Moreover, it is provided that a guide bar group is arranged in the axial direction opposite the free end of the honing tool on at least one cutting bar group.

It is furthermore provided in the honing tool that the honing tool has an air measuring device. In particular the conventional honing can be monitored with it during the working.

BRIEF DESCRIPTION OF THE DRAWING

Furthermore, features important for the invention are found in the following description and in the drawings, wherein the features can be important alone or also in various combinations without this being explicitly referred to.

Exemplary embodiments of the invention are explained in the following by way of example using the figures. In the figures:

FIG. 4 includes FIGS. 4A through 4C;

FIG. 4A shows a cross section A-A from FIG. 2;

FIG. 4B shows a cross section B-B from FIG. 2;

FIG. 4C shows a cross section C-C from FIG. 2; and

DETAILED DESCRIPTION OF THE BEST MODE OF THE INVENTION

Figure 1:
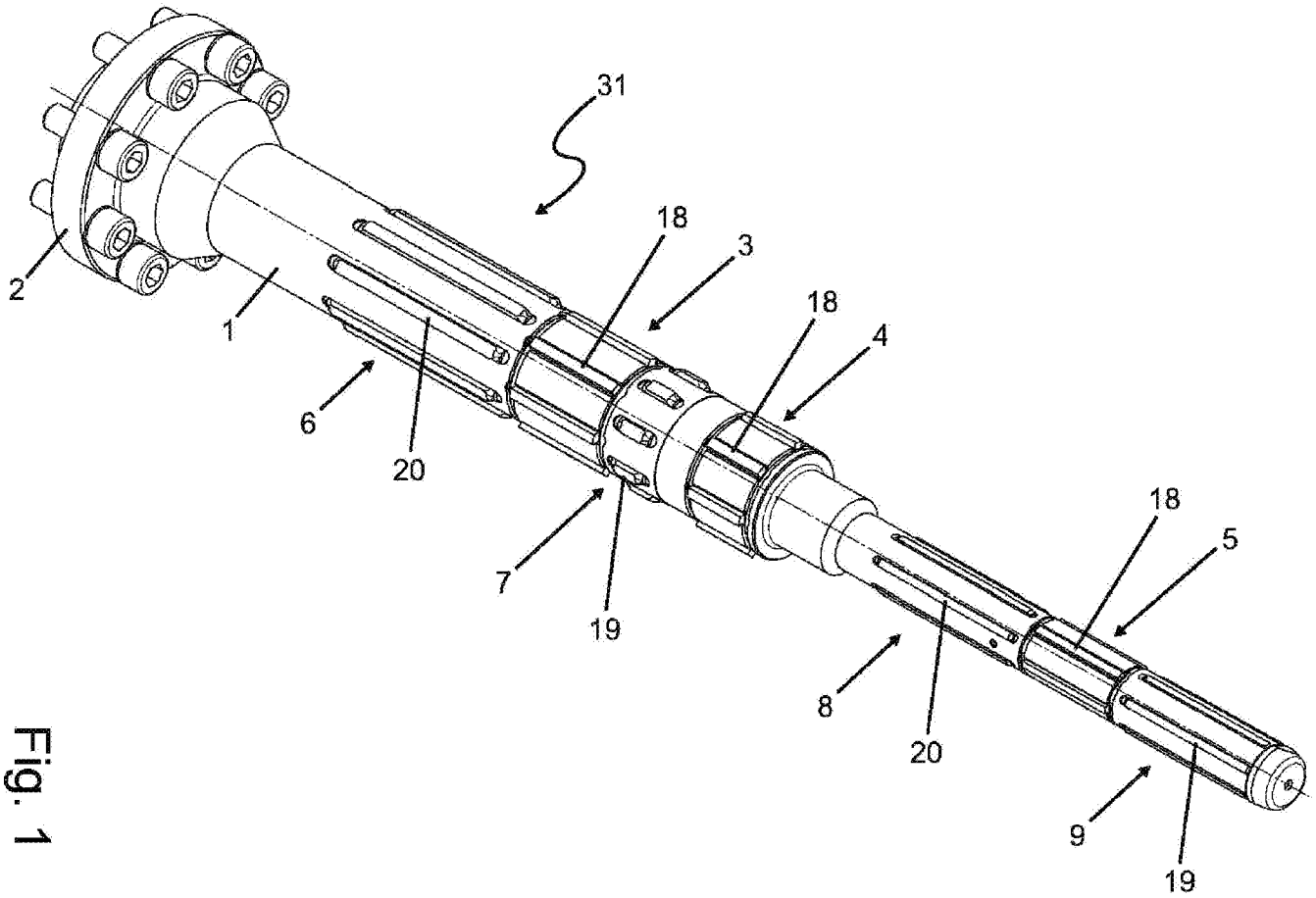
FIG. 1 shows a honing tool according to the invention in a perspective view.

FIG. 1 shows an exemplary embodiment of a honing tool 31 in accordance with the invention in a perspective view in detail. The honing tool 31 shown is especially designed for working the bores 17 (see FIG. 5). In the case of bores with different geometries the honing tool 31 must be appropriately adapted.

The honing tool 31 comprises a tool body 1 in the receptacle 2 via which the honing tool 31 can be coupled in a flange-like manner to a spindle of a commercial honing machine which is not shown.

The connection of the honing tool 31 to the spindle can take place, e.g., by a double-jointed (cardanic) drive rod. A rigid connection between the honing tool 31 and the spindle is also possible. In a vertically working honing machine the cardanic connection to the spindle is preferred. In a horizontally working honing machine the rigid connection is preferred.

The honing machine can be designed, e.g. with a conventional double feed system, wherein the cutting speeds and radial feed positions can be automatically controlled for different honing methods (e.g. friction honing and conventional honing).

During friction honing, e.g. the honing process is carried out with very few strokes, e.g. a double stroke. Almost the entire removal of material takes place during the downward stroke; the upward stroke serves rather to smooth the previously worked surface.

During conventional honing (also called oscillating honing) the honing is carried out by rotation of the honing tool 31 with multiple stroke repetitions.

Separately arranged cutting bar groups 3, 4, 5 are provided on the honing tool 31 for the working of three bores 17*a*, 17*b*, 17*c* (see FIG. 5). The cutting bar group 3 is provided for working the bore 17*a*, the cutting bar group 4 is provided for working the bore 17*b* and the cutting bar group 5 is provided for working the bore 17*c*. The number of bores with the associated cutting bar groups can be as desired and is assumed to be exemplary in the FIGS. 1 to 4.

Each cutting bar group 3, 4, 5 comprises cutting bars 18 arranged on the circumference for working the bores 17.

The honing tool 31 also comprises two centering bar groups 7 and 9 arranged in the direction of the free end of the honing tool 31, preferably directly adjacent to the cutting bar groups 3 and 5. The centering bar groups 7, 9 serve, especially at the beginning of the working, to align the honing tool 31 in the bores 17. Centering bar groups can also be arranged in the area of other cutting bar groups or in the area of all cutting bar groups.

The centering bar groups 7, 9 comprise several centering bars 19 which are distributed in a top view onto the honing tool 31 preferably uniformly over the circumference of the honing tool 31. The centering bars 19 execute no machining but rather serve to guide and center the honing tool 31 in the bore to be worked; they cannot be radially adjusted. However, they could also be constructed to be adjustable.

The honing tool 31 furthermore comprises two guide bar groups 6 and 8 approximately in the middle and on its end facing the spindle of the honing machine which groups are preferably arranged directly adjacent to the cutting bar groups 3 and 5. The guide bar groups 6, 8 serve to stabilize and center the honing tool 31 when the cutting bar group 4 is active.

This is the case, for example, when a working of the bore 17*b* (see FIG. 5) is carried out with the cutting bar group 4 without the other bores 17*a* and 17*c* being worked at the same time. If, as shown in FIG. 5, the bores 17*a* and 17*c* are through bores, they can then be worked by friction honing. Since in the example shown the bore 17*b* is a stepped bore with a relief groove 17*d*, the bore 17*b* is worked by conventional honing. Guide bar groups can also be arranged—depending on the application—in the area of other cutting bar groups.

The guide bar groups 6, 8 comprise several guide bars 20 distributed in a top view over the honing tool 31 in a regular manner over the circumference of the honing tool 31. The guide bars 20 cannot be radially adjusted. However, they can also be constructed to be adjustable.

Figure 2:
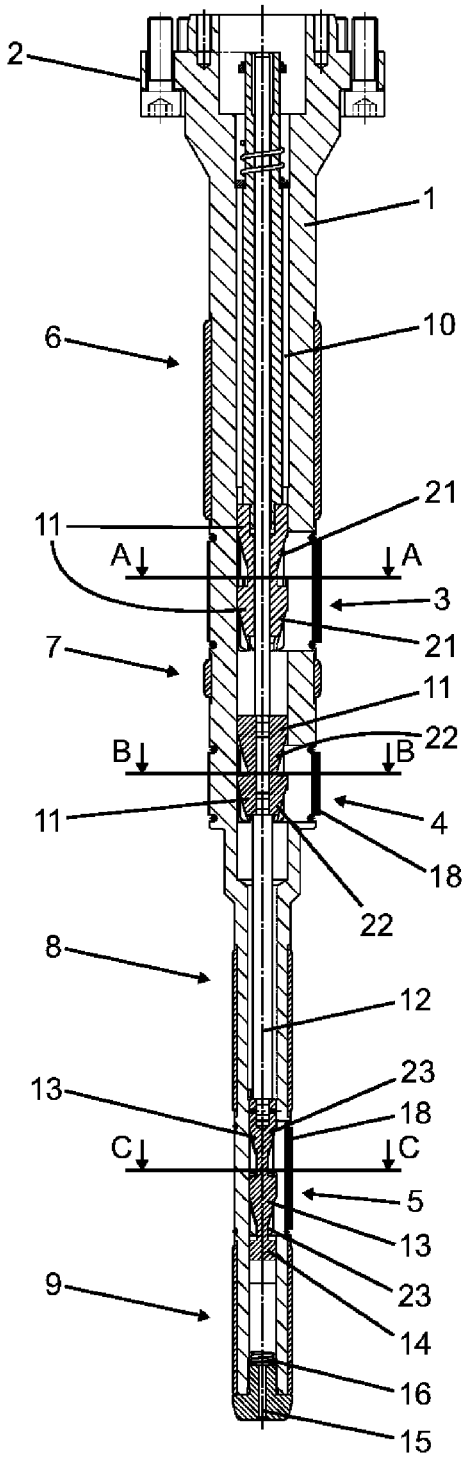
FIG. 2 shows a longitudinal section through the honing tool of FIG. 1.

FIG. 2 shows the honing tool 31 in a longitudinal section. In addition to the tool body 1 and the tool receptacle device 2 this figure explains how the different cutting bar groups are delivered.

FIG. 2 shows a first feed system. In it a feed tube 10 activates two groups of feed cones 11 which move the cutting bars 18 of the first cutting bar group 3 and the cutting bars 18 of the second cutting bar group 4 radially outward together. The cutting bars 18 of the cutting bar group 3 comprise two conical feed surfaces 21 at a distance from one another which cooperate with the feed cones 11.

The cutting bars 18 of the cutting bar group 4 comprise two conical feed surfaces 22 at a distance from one another which cooperate with the feed cones 11.

Each cutting bar 18 of the cutting bar groups 3, 4 is therefore supported twice so that the feed force of the feed tube 10 acts on both ends on the cutting bars 18.

A feed rod 12 is guided through the feed tube 10. It is connected to the feed cones 13. The feed cones 13 act on two conical feed surfaces 23 of the cutting bars 18 of the cutting bar group 5, which surfaces are at a distance from one another.

A guide 14 is arranged in FIG. 2 underneath the feed cones 13 which guides and stabilizes in a centered manner the feed cones 13 inside the tool body 1. A closure cap 15 is arranged at the end of the honing tool 31 on which cap a return spring 16 rests inside the tool body 1. The feed force and the feed movement of the feed cones 13 transmitted by the feed rod 12 must overcome the force of the return spring 16.

Therefore, in the honing tool 31 of the invention the cutting bars 18 of the cutting bar groups 3 and 4 are delivered jointly with the aid of the feed tube 10. The cutting bars 18 of the cutting bar group 5 are delivered separately with the aid of the feed rod 12.

However, because the cutting bars 18 of the cutting bar groups 3 and 4 are not active at the same time, the diameters of the bores 17*a* and 17*b* can be adjusted independently of one another. Therefore, in the honing tool 31 according to the invention the diameters of the bores 17*a*, 17*b* and 17*c* can be adjusted independently of each other even though only two feed devices 10, 12 are present. As a result, the honing tool 31 becomes simpler and more economical in its construction and places fewer demands on the honing machine; in particular, it allows the use of a honing machine with two feed devices.

Figure 3:
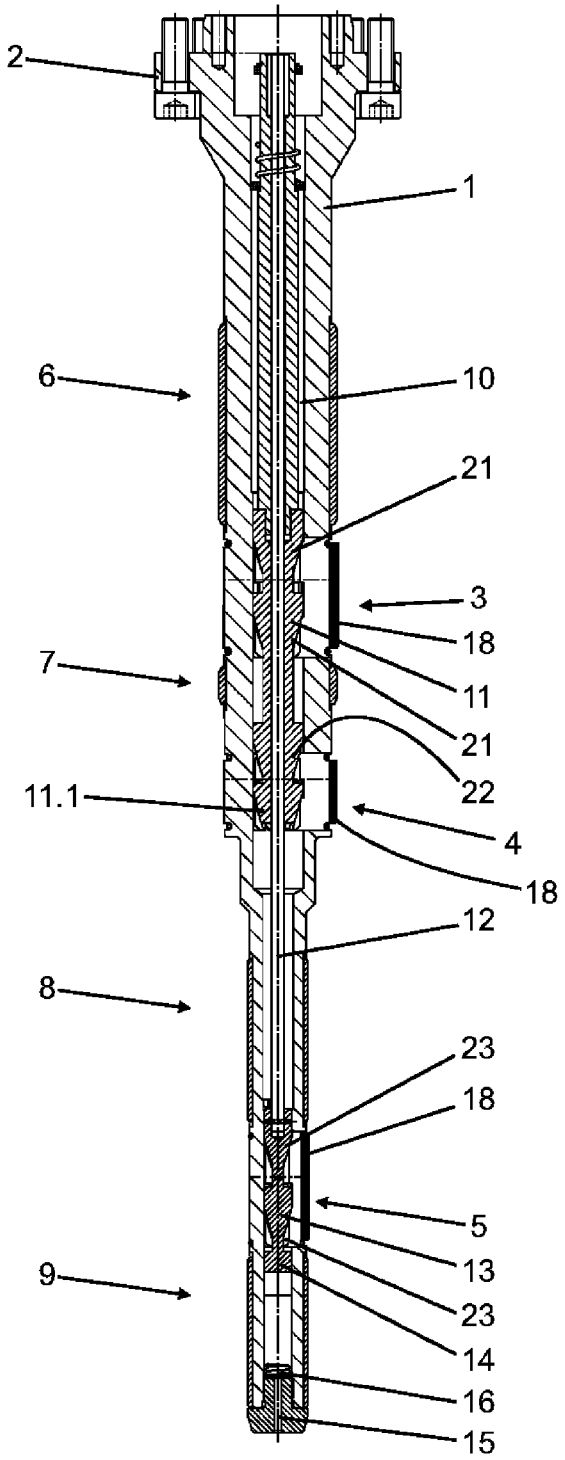
FIG. 3 shows a longitudinal section through the honing tool the FIG. 1 in a changed sectional plane.

FIG. 3 shows the honing tool 31 in a sectional plane changed relative to FIG. 2.

FIG. 4A shows a section through the honing tool 31 along the line A-A (see FIG. 2) in the area of the cutting bar group 3, FIG. 4B shows a section along the line B-B (see FIG. 2) and FIG. 4C shows a section along the line C-C (see FIG. 2) in the area of the cutting bar group 5.

The FIGS. 4A and 4B show the feed rod 12 and the feed cone 11 in the center of the honing tool 31. The cutting bars 18 are uniformly distributed over the circumference of the feed rod 12.

FIG. 4B shows the structural components of the honing tool 31 required for the feed of the second cutting bar group 4. The cutting bars 18 of the second cutting bar group 4 work the stepped bore 17*b* (see FIG. 5).

FIG. 4C shows in the center a feed cone 13 for delivering the cutting bars 18 of the cutting bar group 5.

FIG. 5 shows the honing tool 31 in four different process states. The bores 17*a* and 17*c* are through bores in the example shown and should be worked by friction honing. The bore 17*b* is constructed as a stepped bore which should be worked by conventional honing (oscillating honing).

Figures 5A, 5B, 5C, 5D:
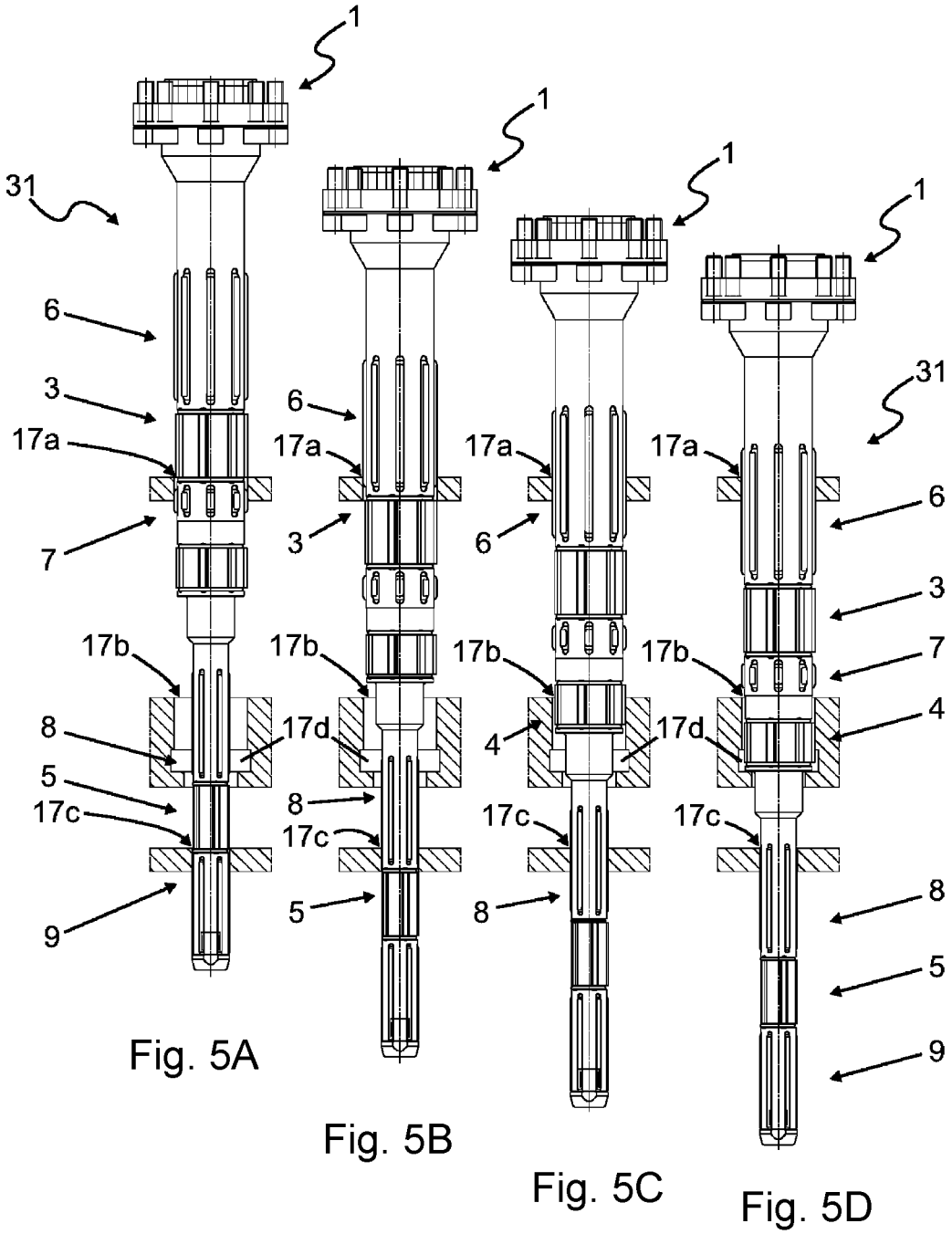
FIG. 5 includes FIGS. 5A, 5B, 5C and 5D, which show the honing tool from FIG. 1 in four different processing states.

FIG. 5A shows the honing tool 31 moved into the bores 17*a*, 17*b* and 17*c*, which is axially aligned by the centering bar group 7 in the bore 17*a* and by the centering bar group 9 in the bore 17*c*. It is clear here that the axial distances of the centering bar groups 7 and 9 correspond approximately to the axial distance of the bores 17*a* and 17*c*. A corresponding situation also applies to the cutting bar groups 3 and 5 of the honing tool 31. Slight differences in the axial distance can be desired because as a result, sudden loading peaks are avoided and the stressing of the honing machine and of the honing tool 31 is evened out.

The axial distance of the cutting bar groups 3 and 5 of the centering bar groups 7 and 9 is selected in such a manner that a brief overlapping takes place here and therefore the cutting bar groups 3, 5 as well as the centering bar groups 7, 9 are located in the bores 17*a* and 17*c* and the centered position remains preserved.

In other words: the axial distance of the cutting bar group 3 from the centering bar group 7 is less than the axial extension of the bore 17*a* to be worked so that the cutting bars 18 of the cutting bar group 3 enter into the bore 17*a* before the centering bar group 7 leaves the bore 17*a* if the honing tool 31 goes deeper into the bore 17. A corresponding situation also applies to the cutting edge group 5 and the centering bar group 9.

This ensures that the honing tool 31 is also guided even during a passage from the working of a bore to the next bore and the centered position remains preserved.

At first the honing tool 31 is centered by the centering bar groups 7 and 9 in the bores 17*a* and 17*c*. Subsequently, the honing tool 31 moves further into the bores 17 and brings the cutting bars 18 of the cutting bar groups 3 and 5 in engagement with the bores 17*a* and 17*c* to be worked. Therefore, the bores 17*a* and 17*c* are worked to a finished state simultaneously by friction honing. The cutting bar groups 3 and 5 are preferably designed for friction honing with one or a few slow strokes. Friction honing is an established honing method in which the cutting bars are moved similar to a friction awl in an axial movement through the bore to be worked.

The FIG. 5B shows the position of the cutting bar groups 3 and 5 at the end of the friction honing working of the bores 17*a* and 17*c*. In this position the guide bar groups 6 and 8 move into the previously friction-honed bores 17*a* and 17*c*, as a result of which the guided tool position in the bores 17*a* and 17*c*, which have now been worked to a finished state, remains preserved unchanged.

The guide bar groups 6 and 8 are adjusted to the smallest possible undersize to the previously honed bores 17*a* and 17*c* so that a play-free guidance of the honing tool 31 is ensured for the following further working of the middle core 17*b* with a low friction at the same time.

FIG. 5C shows the working of the bore 17*b*, which is constructed as a stepped bore and can therefore not be worked to a finished state by friction honing.

The bore 17*b* is therefore worked by conventional honing by the cutting bar group 4. At this time the cutting bar group 4 oscillates axially in the bore 17*b*. at the same time the honing tool 31 rotates.

FIG. 5C shows the cutting bar group 4 in the upper end position of the oscillating stroke movement. FIG. 5D shows the cutting bar group 4 in the lower end position of the oscillating stroke movement. The honing tool 31 is always guided here by the guide bar groups 6 and 8 in the two other bores 17*a* and 17*c*, as a result of which a coaxial working of the bore 17*b* to the bores 17*a* and 17*c* is ensured. The working of the bore 17*b* (oscillating honing) therefore differs from the working of the bores 17*a* and 17*c* (friction honing).

The cutting bar group 3 is also delivered with the feed of the cutting bar group 4 since both cutting bar groups 3 and 4 are moved by the same feed cone 11. Since the cutting bar group 3 is located here outside the bore 17*a* the change in diameter of the cutting bar group 3 does not bring about a change of the diameter of the bore 17*a* worked to a finished state. The cutting bar group 5 is also located here outside of the bore 17*c*.

Basically, e.g. even the bores 17*a* and 17*b* can be worked by friction honing in the method of the invention and with the honing tool 31 according to the invention, wherein the bore 17*c* can subsequently be conventionally honed with an oscillating tool. There is also the possibility that the bores 17*b* and 17*c* are worked by friction honing and the bore 17*a* is conventionally honed in an oscillating manner.

Therefore, through bores, stepped bores and blind-end bores with a relief groove can be worked with the procedure of the invention in a clamp and with a honing tool 31. In any case a coaxial improvement of the accuracy of the position of the bores 17*a*, 17*b* and 17*c* to each other can take place by one of the cited working variants.

In other exemplary embodiments the number of bores to be worked can also deviate from the example shown so that either only two or more than three bores can be worked in one work step. At least one bore can be worked in this case by friction honing and at least one bore by conventional honing.

Figure 6:
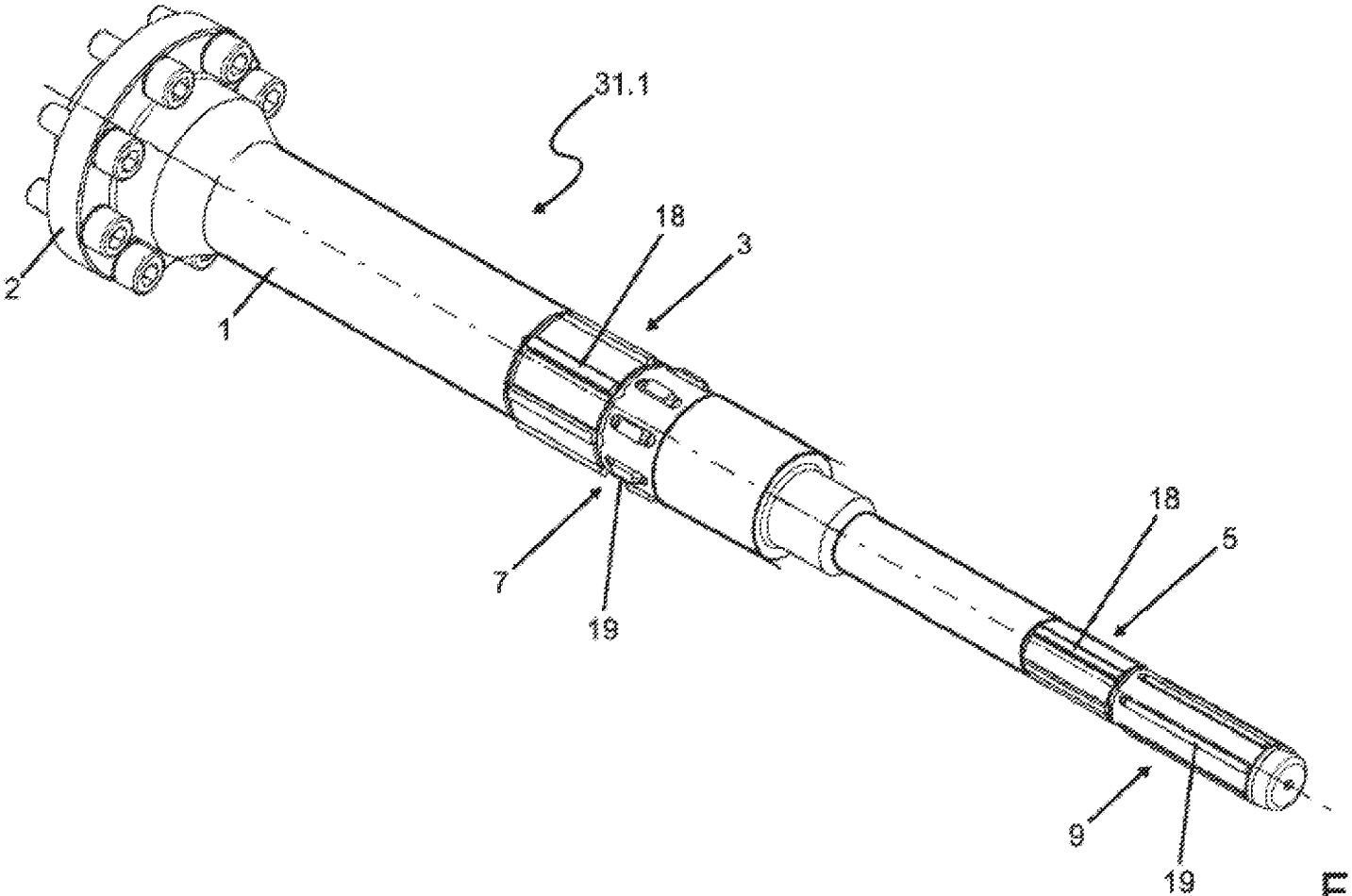
FIGS. 6 and 7 show a combination of two honing tools according to the invention.
Figure 7:
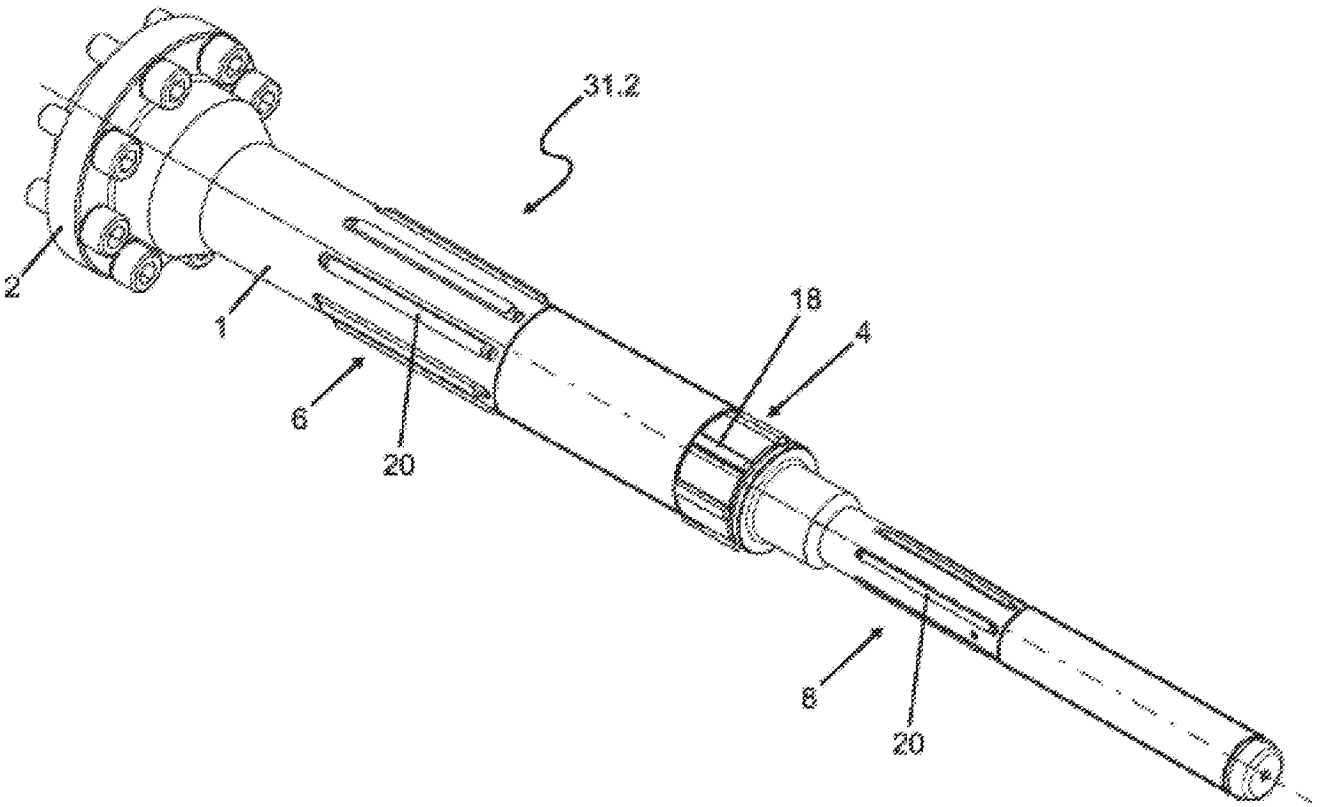

It is also possible to divide the honing tool 31 shown and described in FIGS. 1 to 4 into two honing tools; this is designated as a combination of honing tools and is explained using FIGS. 6 and 7. The working of the bores 17*a* to *c* then takes place in two work steps, wherein in a first work step the through bores 17*a* and *c* are worked with the first honing tool and in a second work step the stepped bore 17*b* is worked with the other honing tool.

The first honing tool 31.1 furthermore comprises two centering bar groups 7 and 9 arranged in the direction of the free end of the honing tool 31.1 preferably directly adjacent to the cutting bar groups 3 and 5. Centering bar groups could also be arranged in the area of other cutting bar groups or in the area of all cutting bar groups.

The centering bar groups 7, 9 comprise several centering bars 19 distributed in a top view on the honing tool 31 preferably uniformly over the circumference of the honing tool 31. The centering bars 19 do not perform any machining but rather serve for the guiding and centering of the tool 31 in the bore to be worked; they cannot be radially adjusted. However, they could also be constructed to be adjustable.

FIG. 6 shows the first honing tool 31.1 in a perspective view in detail. The first honing tool 31.1 is aligned especially for working bores 17*a* and *c*. In the case of bores with other geometries the first honing tool 31.1 must be appropriately adapted. The first honing tool 31.1 and the second honing tool 31.2 have very many agreements with the honing tool 31 according to the FIGS. 1 to 4 so that only the essential differences are briefly explained in the following.

For the working of the bores 17*a* and 17*c* (see FIG. 5) two separately arranged cutting bar groups 3 and 5 are provided on the first honing tool 31.1. The cutting bar group 3 is provided for working the bore 17*a* and the cutting bar group 5 is provided for working the bore 17*c*.

FIG. 7 shows an exemplary embodiment of a second honing tool 31.2 in a detailed perspective view. The second honing tool 31.2 shown is aligned especially for working the bore 17*b* (see FIG. 5). A cutting bar group 4 is provided on the second honing tool 31.2 for working the bore 17*b* (see FIG. 5).

The second honing tool 31.2 furthermore comprises two guide bar groups 6 and 8 approximately in the middle and on its end facing the spindle of the honing machine. The guide bar groups 6, 8 serve to stabilize and center the tool 1 when the cutting bar group 4 is active. This is the case, for example, when a working of the bore 17*b* (see FIG. 5) is being carried out with the cutting bar group 4 without the other bores 17*a* and 17*c* being worked at the same time. Guide bar groups can also be arranged in the area of other cutting bar groups—depending on the application.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

The invention claimed is:

1. A honing tool (31) for working several separate bores (17*a*,17*b*, 17*c*) that are arranged coaxially in series and have different diameters, wherein the honing tool (31) comprises several cutting bar groups (3, 4, 5) arranged coaxially in series, wherein a diameter of a cutting bar group (3, 4, 5) of the several cutting bar groups (3, 4, 5), which diameter is formed by radially extendable cutting bars (18), differs from a corresponding diameter of at least one other cutting bar group (3, 4, 5) of the several cutting bar groups (3, 4, 5), characterized in that

- a centering bar group (7, 9) is arranged in an axial direction to a free end of the honing tool (31) adjacent at least one cutting bar group (3, 5), or
- a guide bar group (6, 8) is arranged directly adjacent opposite the free end of the honing tool (31) adjacent the at least one cutting bar group (3, 4, 5), or
- both the centering bar group (7, 9) is arranged in the axial direction to the free end of the honing tool (31) adjacent the at least one cutting bar group (3, 5) and the guide bar group (6, 8) is arranged directly adjacent opposite the free end of the honing tool (31) adjacent the at least one cutting bar group (3, 4, 5).

2. The honing tool (31) according to claim 1, characterized in that the several cutting bar groups (3, 4, 5) have corresponding different diameters that are coaxially arranged in series and are equally large or decrease toward the free end of the honing tool (31).

3. The honing tool (31) according to claim 1, characterized in that the centering bar group (7, 9) and the guide bar group (6, 8) each comprises at least three bars (18, 19, 20).

4. The combination of two honing tools (31.1, 31.2) according to claim 3, characterized in that the honing tool (31, 31.1, 31.2) comprises at least one feed device (10, 12).

5. The combination of two honing tools (31.1, 31.2) according to claim 4, characterized in that each feed device (10, 12) delivers at least one cutting bar group (3, 4, 5).

6. The combination of two honing tools (31.1, 31.2) according to claim 3, characterized in that the honing tool (31, 31.1, 31.2) comprises an air measuring device.

7. The honing tool (31) according to claim 1, characterized in that the honing tool (31, 31.1, 31.2) comprises at least one feed device (10, 12).

8. The honing tool (31) according to claim 7, characterized in that each feed device (10, 12) delivers at least one cutting bar group (3, 4, 5).

9. The honing tool (31) according to claim 1, characterized in that the honing tool (31, 31.1, 31.2) comprises an air measuring device.

10. A method according to claim 1, characterized in that during a single work step at least one through bore (17*a*, 17*c*) is worked by at least one first cutting bar group (3, 5) and subsequently a stepped bore (17*b*) is worked by at least one second cutting bar group (4).

11. The method according to claim 10, characterized in that the at least one through bore (17*b*) is worked by an oscillating honing.

12. A control device for a honing machine, characterized in that the control device is programed for using a method according to claim 10.

13. The method according to claim 10, characterized in that the at least one through bore (17*b*) is worked by an oscillating honing.

14. A combination of a first honing tool (31.1) and a second honing tool (31.2) for working several separate bores (17*a*, 17*b*, 17*c*) that are arranged coaxially in series and have different diameters, wherein a first honing tool (31.1) comprises several cutting bar groups (3, 5) arranged coaxially in series, wherein a diameter of a cutting bar group (3, 5) of the several cutting bar groups (3, 4, 5), which diameter is formed by cutting bars (18) which can be radially extended, differs from a corresponding diameter of at least one other cutting bar group (3, 5) of the several cutting bar groups (3, 4, 5), wherein the at least one cutting bar group (3, 5) of the first honing tool (31.1) is designed and arranged so that at least one through bore (17*a*, 17*c*) can be worked by the at least one cutting bar group (3, 5), wherein the second honing tool (31.2) comprises a respective cutting bar group (4) of the several cutting bar groups (3, 4, 5), that two guide bar groups (6, 8) are provided coaxially and at an axial distance to the respective cutting edge group (4) that corresponds to an associated axial distance of the several cutting bar groups (3, 5) of the first honing tool (31.1).

15. A method according to claim 3, wherein another honing tool (31.2) comprises at least one cutting bar group (4) and at least one guide bar group (6, 8), characterized in that during a first work step at least one first cutting bar group (3, 5) works at least one through bore (17*a*, 17*c*) and during a second work step the second honing tool (31.2) is supported with at least one of the two guide bar groups (6, 8) in at least one through bore (17*a, c*) of the several through bores (17*a*, 17*b*, 17*c*) and a stepped bore (17*b*) is worked by at least one second cutting bar group (4).

16. The method according to claim 15, characterized in that the at least one through bore (17*a*, 17*c*) is worked by a friction honing.

17. The combination of two honing tools (31.1, 31.2) according to claim 14, characterized in that the centering bar group (7, 9) and the two guide bar groups (6, 8) each comprise at least three bars (18, 19, 20).

18. The combination of two honing tools (31.1, 31.2) according to claim 14, characterized in that the honing tool (31, 31.1, 31.2) comprises at least one feed device (10, 12).

19. The combination of two honing tools (31.1, 31.2) according to claim 18, characterized in that each feed device (10, 12) delivers at least one cutting bar group (3, 4, 5).

20. The honing machine according to claim 18, characterized in that some combination of a tool magazine, a tool changer (21), or a zero ring is arranged on a substructure (7) or a stand (1).

21. The combination of two honing tools (31.1, 31.2) according to claim 14, characterized in that the honing tool (31, 31.1, 31.2) comprises an air measuring device.

* * * * *